US009495938B2

(12) United States Patent
Ko

(10) Patent No.: US 9,495,938 B2
(45) Date of Patent: Nov. 15, 2016

(54) DISPLAY APPARATUS

(71) Applicant: Acer Incorporated, New Taipei (TW)

(72) Inventor: Chueh-Pin Ko, New Taipei (TW)

(73) Assignee: Acer Incorporated, New Taipei (TW)

( * ) Notice: Subject to any disclaimer, the term of this patent is extended or adjusted under 35 U.S.C. 154(b) by 79 days.

(21) Appl. No.: 13/896,349

(22) Filed: May 17, 2013

(65) Prior Publication Data

US 2014/0009507 A1 Jan. 9, 2014

(30) Foreign Application Priority Data

Jul. 9, 2012 (TW) ..... 101124640 A

(51) Int. Cl.
*G09G 5/10* (2006.01)
*G09G 3/20* (2006.01)

(52) U.S. Cl.
CPC *G09G 5/10* (2013.01); *G09G 3/20* (2013.01); *G09G 2300/023* (2013.01); *G09G 2330/021* (2013.01); *G09G 2360/144* (2013.01)

(58) Field of Classification Search
CPC ..... Y02E 10/549; Y02E 10/50; H01L 31/02167; H01L 31/022425; C08G 2261/91; G09G 2360/144; G09G 2360/14; G09G 2330/00; G09G 2330/02–2330/024
See application file for complete search history.

(56) References Cited

U.S. PATENT DOCUMENTS

| | | | | |
|---|---|---|---|---|
| 8,130,440 | B2 * | 3/2012 | Kothari et al. | 359/290 |
| 2009/0103161 | A1 * | 4/2009 | Kothari | G02F 1/13306 359/245 |
| 2010/0279740 | A1 * | 11/2010 | Lee | G06F 1/3203 455/566 |
| 2011/0128264 | A1 * | 6/2011 | Lee et al. | 345/207 |
| 2011/0175874 | A1 | 7/2011 | Wakimoto et al. | |
| 2011/0181233 | A1 * | 7/2011 | Mino et al. | 320/101 |
| 2012/0127140 | A1 | 5/2012 | Ryan et al. | |

FOREIGN PATENT DOCUMENTS

| | | |
|---|---|---|
| CN | 102142702 | 8/2011 |
| TW | 201137839 | 11/2011 |

* cited by examiner

*Primary Examiner* — Lixi C Simpson
*Assistant Examiner* — Ngan T Pham Lu
(74) *Attorney, Agent, or Firm* — Jianq Chyun IP Office

(57) ABSTRACT

A display apparatus including a display module and a solar cell module is provided. The display module displays image content and provides a charging light, wherein the energy of the charging light is related to the image content. The solar cell module is disposed at one side of the display module to receive the charging light and proceed to charge, wherein the efficiency of charging for the solar cell module is related to the image content displayed by the display module.

13 Claims, 9 Drawing Sheets

DISPLAY APPARATUS

CROSS-REFERENCE TO RELATED APPLICATION

This application claims the priority benefit of Taiwan application serial no. 101124640, filed on Jul. 9, 2012. The entirety of the above-mentioned patent application is hereby incorporated by reference herein and made a part of this specification.

BACKGROUND OF THE INVENTION

1. Field of the Invention

The invention relates to a display apparatus having a charging function itself.

2. Description of Related Art

Transmission displays have become an important item developed by each manufacturer since 2010. Also, transmission displays are manufactured and incorporated into walkmans and mobile phones as products. The core technology of the transmission displays is an extended technology of existing panel technologies. For example, a liquid crystal display (LCD) and an organic light-emitting diode (OLED) may both enable the displays to have a transparent effect through the redesigning of pixel and array as well as through the incorporation of transparent materials. In addition, the technology of reflective display such as E-paper with an electro-phoretic display (EPD) or an interferometric modulator (imod) based on micromechanics is also getting ready.

On the other hand, the technology of solar cells having a transparent effect is also getting ready. A transparent solar energy transforming apparatus is disposed on a display module of a portable electronic apparatus, which enables the solar energy to be transformed into electrical energy. A battery may be charged without conventional charging apparatus and external power, which is convenient for users. Therefore, when hand-carried products are popular and power saving is persistently pursued; notebooks and mobile phones having solar charging are increasingly available on the market.

SUMMARY OF THE INVENTION

The invention provides a display apparatus, which is capable of enhancing efficiency of charging for a solar module through changing image content displayed.

An embodiment of the invention provides a display apparatus. The display apparatus includes a display module and a solar cell module. The display module display image content and provides a charging light, wherein energy of the charging light is related to the image content. The solar cell module is disposed at one side of the display module to receive the charging light and proceed to charge, wherein the efficiency of charging for the solar cell module is related to the image content displayed by the display module.

In one embodiment of the invention, when a display apparatus is in high efficiency charging mode, a display module displays high efficiency image content according to a high efficiency image control signal, so as to enhance efficiency of charging for a solar cell module.

In one embodiment of the invention, the display module described above is a reflective display module. A solar cell module is a transmission solar cell module, and the solar cell module is disposed at one side of a reflective light emitting surface of the display module. The display module reflects an ambient light to provide a charging light.

In one embodiment of the invention, when the display apparatus described above is in high efficiency charging mode, a display module displays high efficiency image content which is a white image.

In one embodiment of the invention, the display module described above is a transmission display module. A solar cell module is a reflective solar cell module, and the solar cell module is disposed at one side of a transmission light emitting surface of the display module to receive a charging light, wherein the charging light is an ambient light which transmits the display module.

In one embodiment of the invention, when the display apparatus described above is in high efficiency charging mode, a display module displays high efficiency image content which is a transparent image.

In one embodiment of the invention, the display module described above is a transmission display module. A solar cell module is a transmission solar cell module, and the solar cell module is disposed at one side of a transmission light emitting surface of the display module to receive a charging light, wherein the charging light is an ambient light which transmits the display module.

In one embodiment of the invention, when the display apparatus described above is in high efficiency charging mode, a display module displays high efficiency image content which is a transparent image.

In one embodiment of the invention, a display apparatus further includes a detection unit disposed on a display module or on a solar cell module. The detection unit detects one of a system state of the display apparatus and an intensity of an ambient light. When one of the system state of the display apparatus or the intensity of the ambient light meets the conditions of getting into high efficiency charging mode, a high efficiency image control signal is outputted.

In one embodiment of the invention, when a detection unit detects that a display apparatus is in a low power state or in a standby state, that the display apparatus is set to high efficiency charging mode, that a way the display apparatus is placed matches a predetermined way of placing, or that when an intensity of an ambient light is too low, the detection unit outputs a high efficiency image control signal.

An embodiment of the invention provides a high efficiency charging method for a display apparatus, wherein the display apparatus includes a display module and a solar cell module. The high efficiency charging method for the display apparatus includes steps of detecting a system state of the display apparatus or an intensity of an ambient light, judging if the display apparatus meets the conditions of getting into high efficiency charging mode according to the system state of the display apparatus or the intensity of the ambient light, and controlling the display module to display high efficiency image content if the system state of the display apparatus or the intensity of the ambient light meets the conditions of getting into high efficiency charging mode, so as to enhance energy of a charging light of the solar cell module provided by the display module, which further enhances efficiency of charging for the solar cell module.

In one embodiment of the invention, a charging light is an ambient light which transmits a display module or is obtained through reflecting the ambient light by the display module.

In one embodiment of the invention, judging if a display apparatus meets the conditions of getting into high efficiency charging mode according to a system state of the display apparatus or an intensity of an ambient light includes steps of judging if the display apparatus is in a low power state, if the display apparatus is in a standby state, if the display apparatus is set to high efficiency charging mode, if a way the display apparatus is placed meets a predetermined way of placing, or if the intensity of the ambient light is too low.

In one embodiment of the invention, when a display apparatus is in a low power state or a standby state, when the display apparatus is set to high efficiency charging mode, when a way the display apparatus is placed meets a predetermined way of placing, or when an intensity of an ambient light is too low, the display apparatus meets the conditions of getting into high efficiency charging mode.

In one embodiment of the invention, a high efficiency charging method for a display apparatus further includes detecting if the electricity quantity of a solar cell module is full and keeping detecting the electricity quantity of the solar cell module if the electricity quantity of the solar cell module is full.

According to the aforementioned, the display apparatus in the embodiment of the invention may change energy of a charging light provided by a display module via display content, which further changes efficiency of charging for a solar cell module.

In order to make the aforementioned features and advantages of the invention more comprehensible, embodiments accompanying figures are described in detail below.

BRIEF DESCRIPTION OF THE DRAWINGS

An (a) in FIG. 1 is a display apparatus in an embodiment of the invention in a state of non-high efficiency charging mode, and a (b) is image content displayed by a display module of the (a) in non-high efficiency charging mode.

An (a) in FIG. 2 is a display apparatus in an embodiment in FIG. 1 in a state of high efficiency charging mode, and a (b) is image content displayed by a display module of the (a) in high efficiency charging mode.

Figure 3:
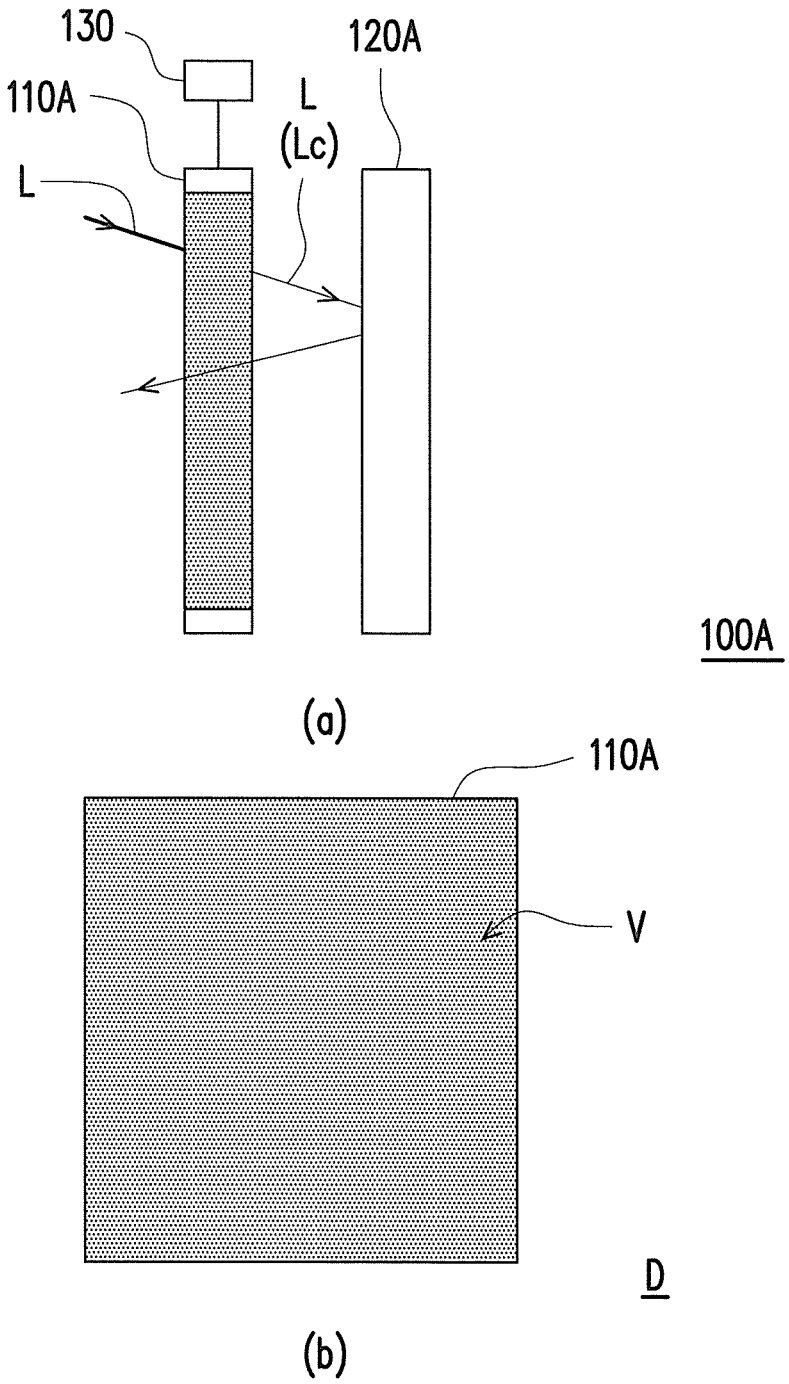

An (a) in FIG. 3 is a display apparatus in another embodiment of the invention in a state of non-high efficiency charging mode, and a (b) is image content displayed by a display module of the (a) in non-high efficiency charging mode.

Figure 4:
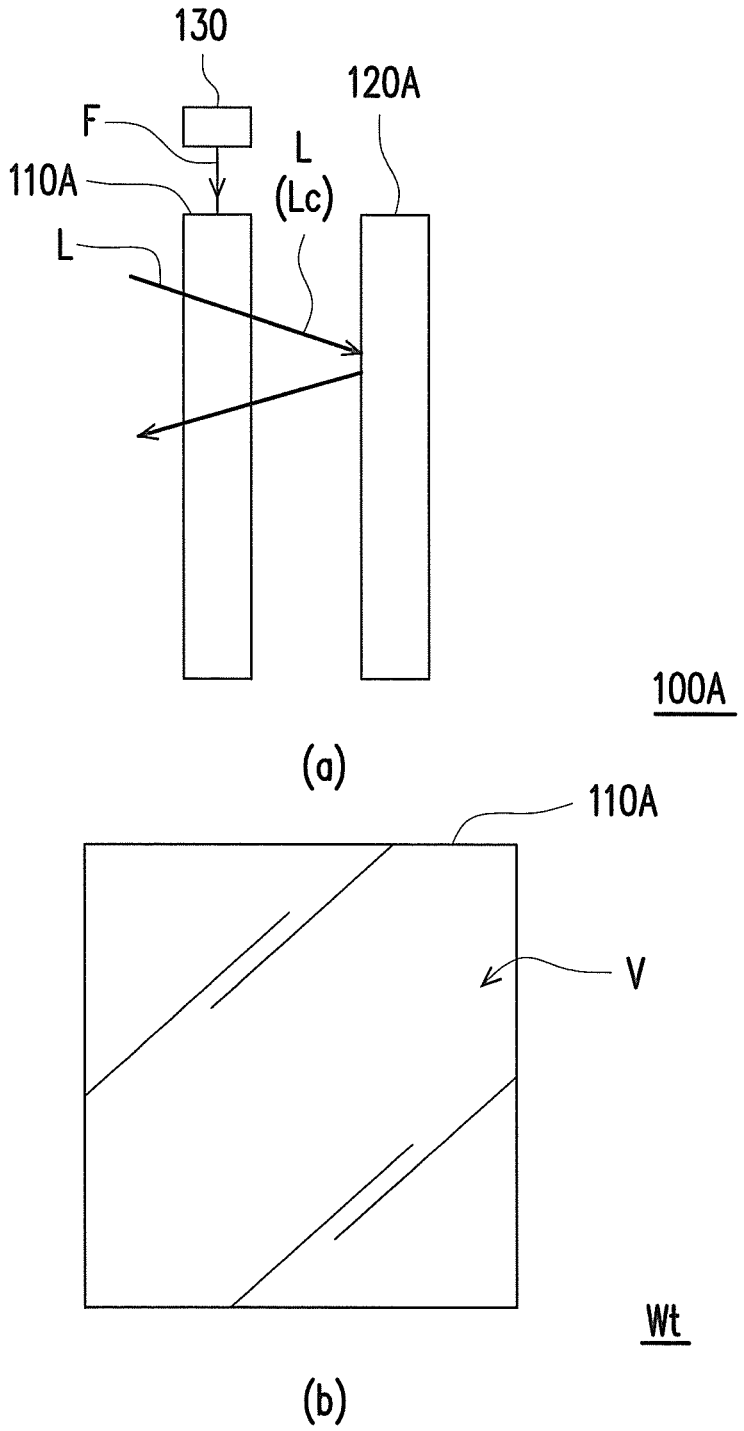

An (a) in FIG. 4 is a display apparatus in an embodiment in FIG. 3 in a state of high efficiency charging mode, and a (b) is image content displayed by a display module of the (a) in high efficiency charging mode.

Figure 5:
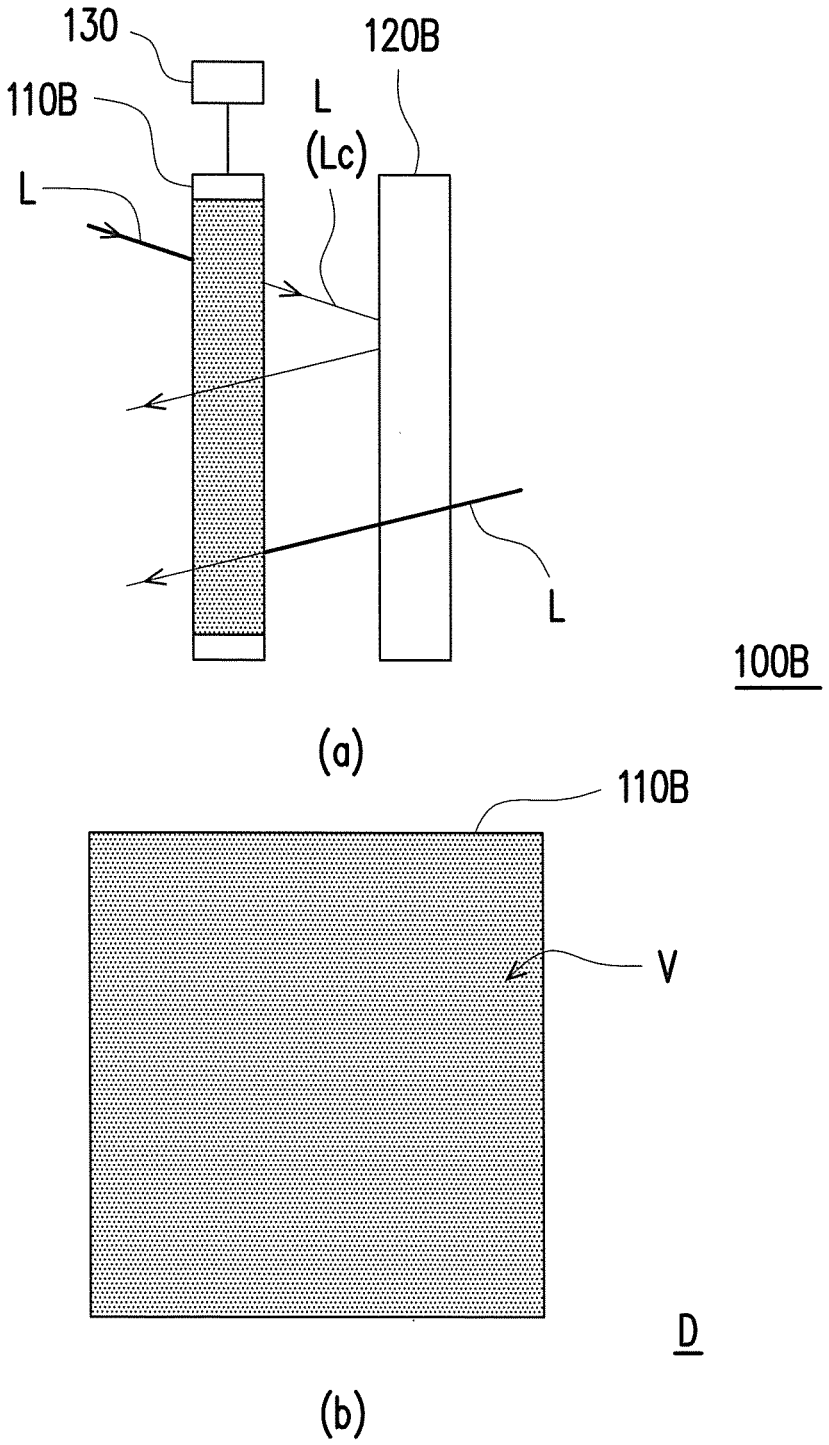

An (a) in FIG. 5 is a display apparatus in another embodiment of the invention in a state of non-high efficiency charging mode, and a (b) is image content displayed by a display module of the (a) in non-high efficiency charging mode.

Figure 6:
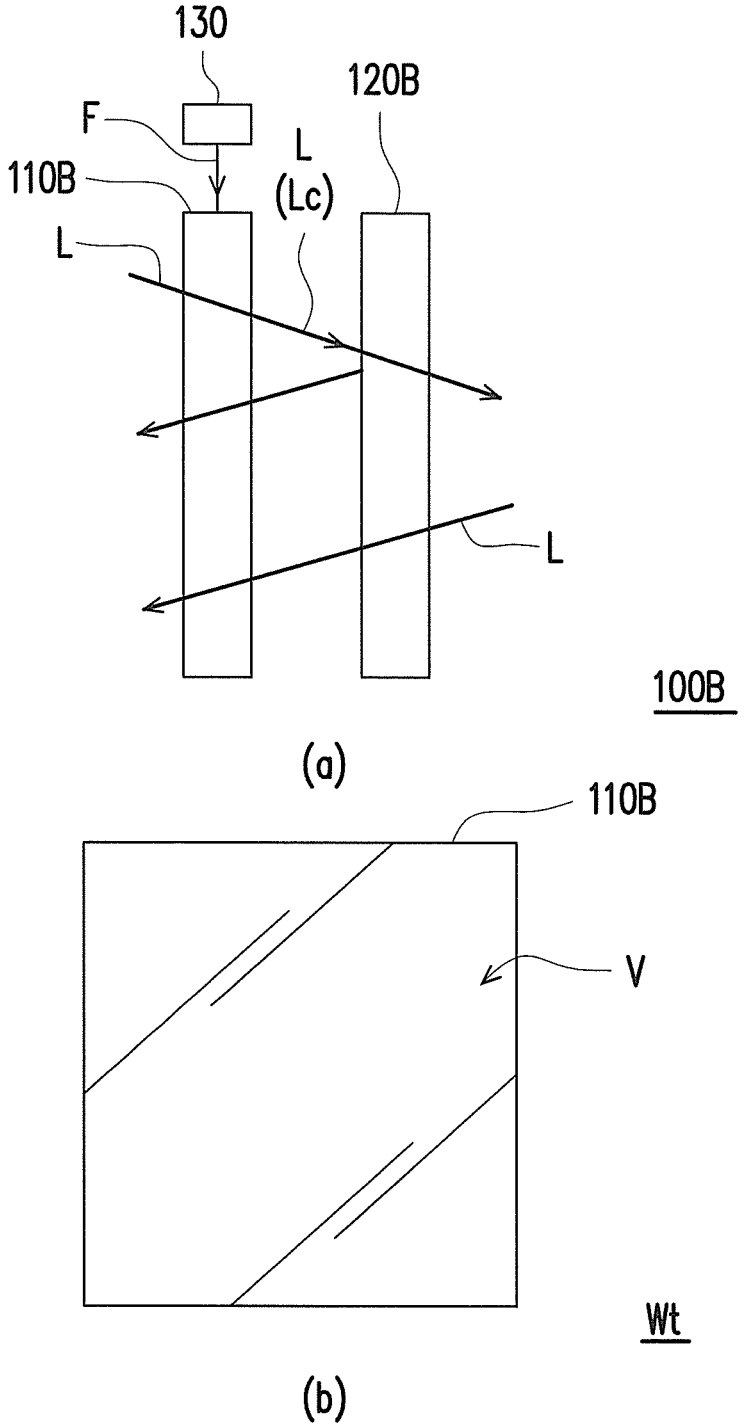

An (a) in FIG. 6 is a display apparatus in an embodiment in FIG. 5 in a state of high-efficiency charging mode, and a (b) is image content displayed by a display module of the (a) in high efficiency charging mode.

Figure 7A:
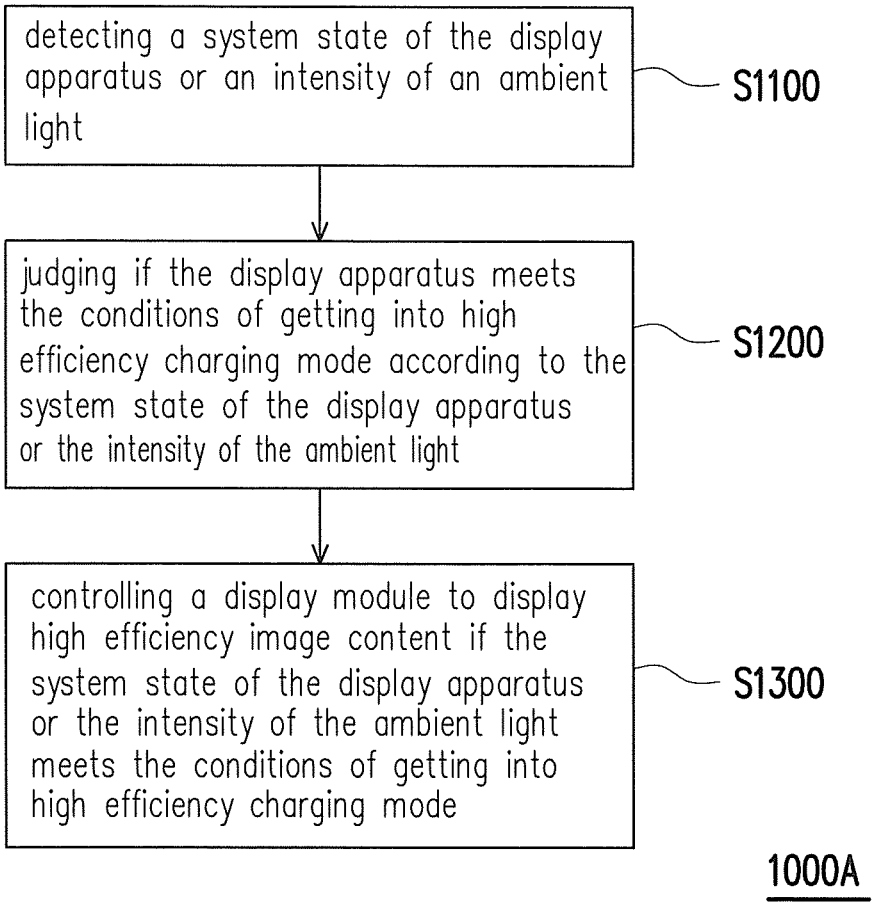
Figure 7B:
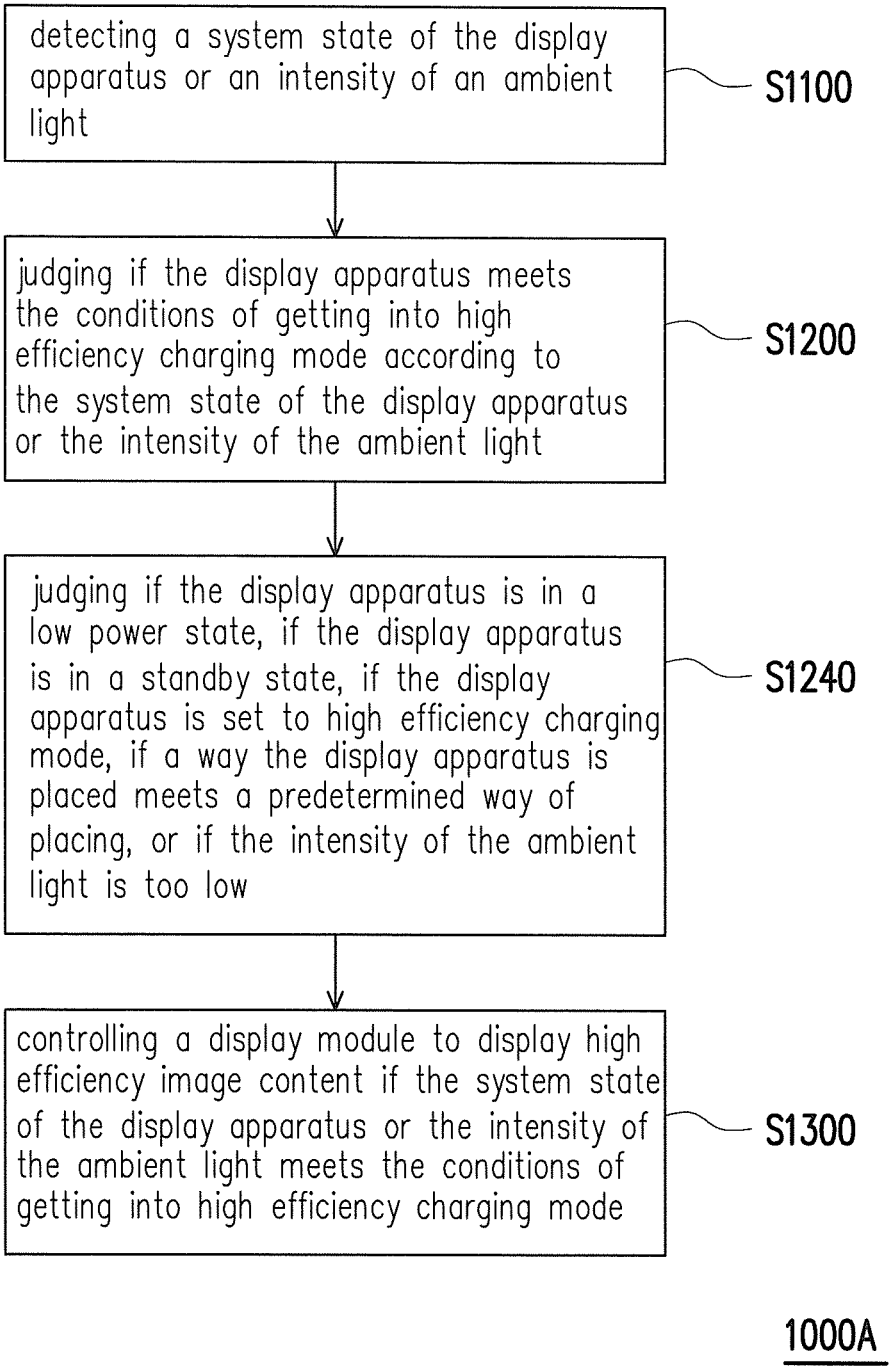

FIGS. 7A and 7B are flow charts of a high efficiency charging method for a display apparatus in an embodiment of the invention.

Figure 8:
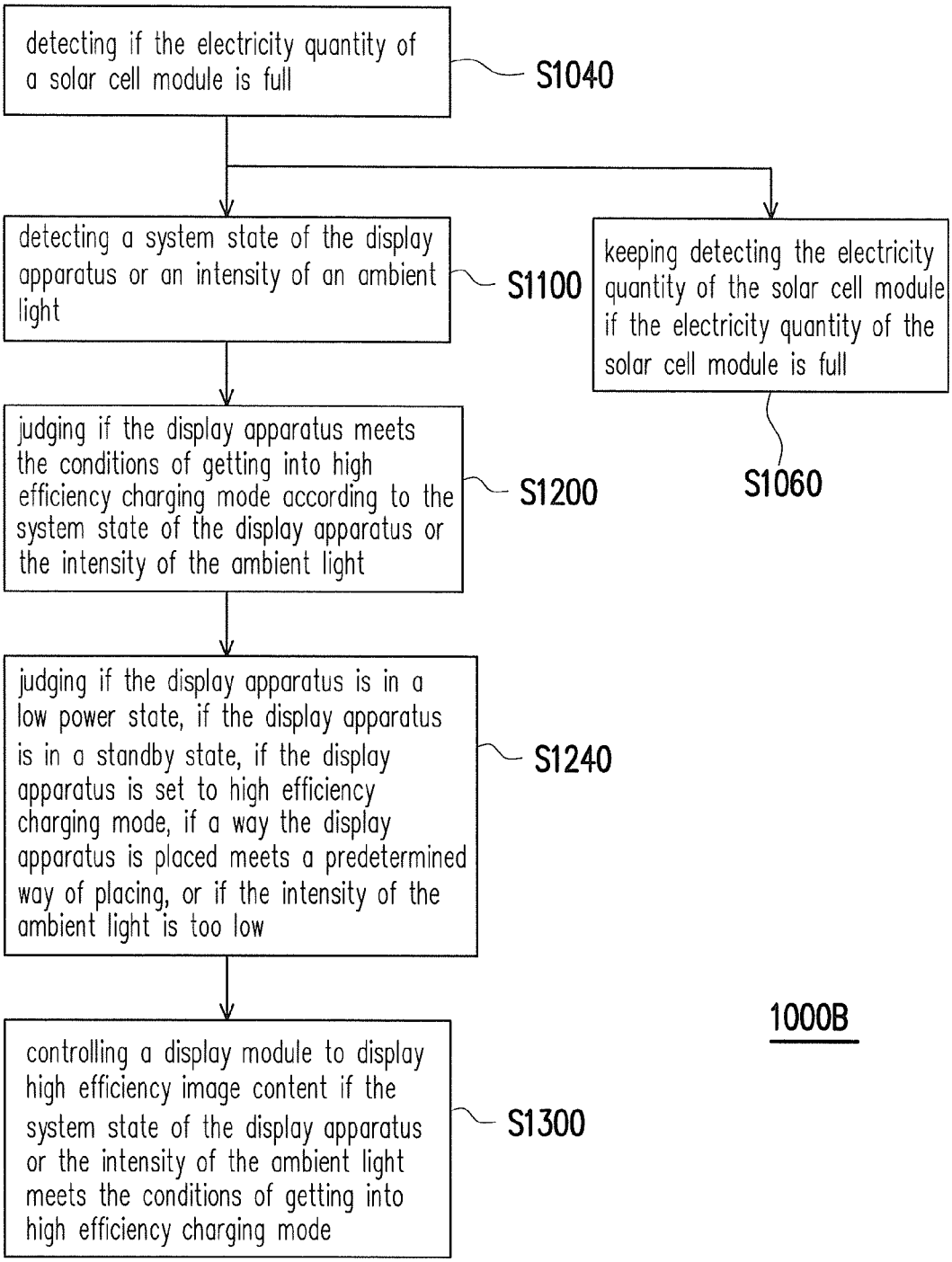

FIG. 8 is a flow chart of a high efficiency charging method for a display apparatus in another embodiment of the invention.

DESCRIPTION OF EMBODIMENTS

Figure 1:
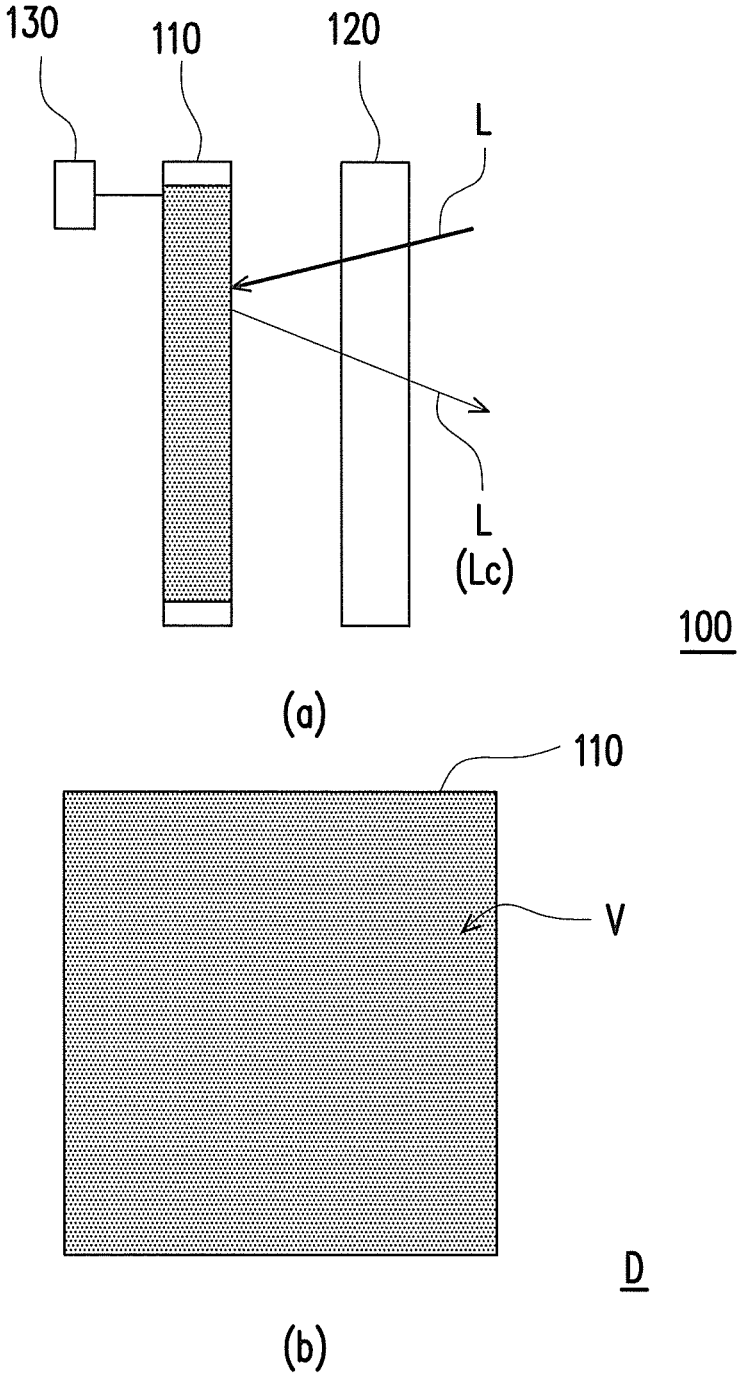
Figure 2:
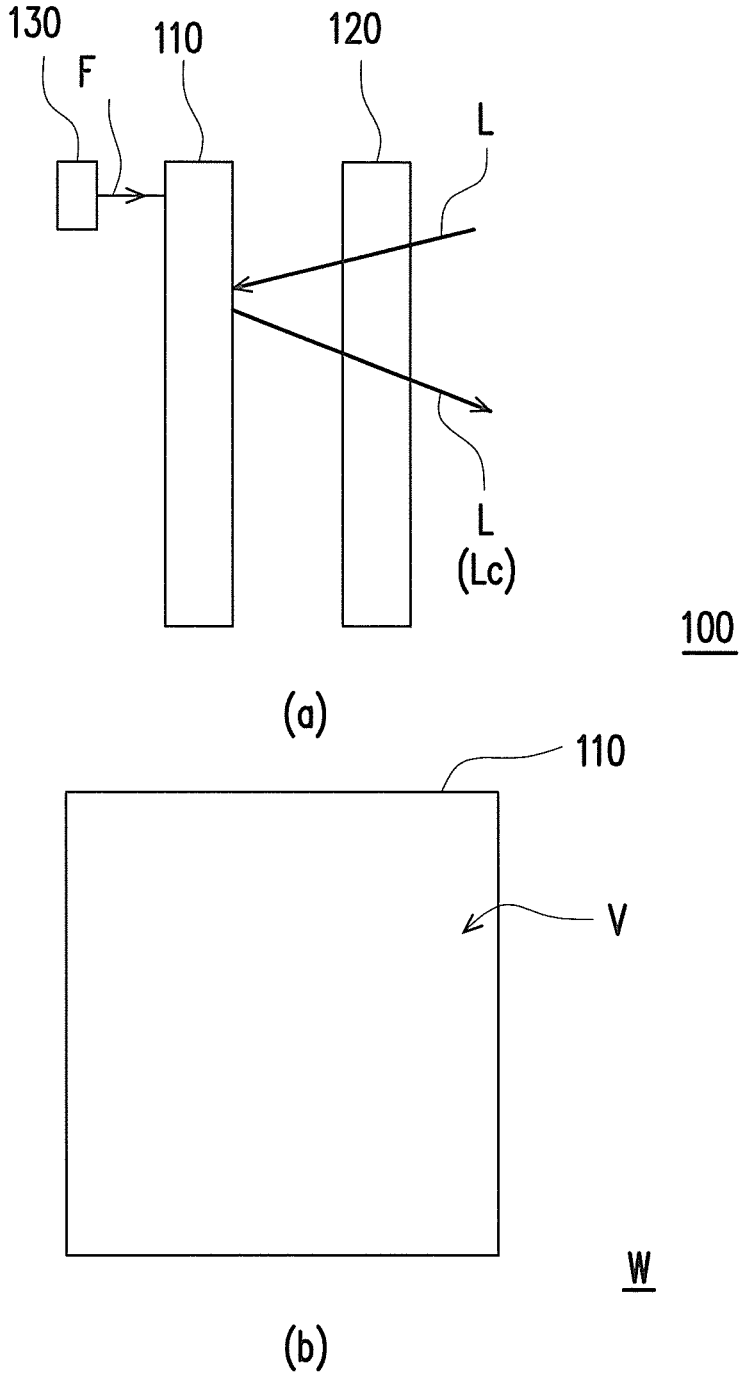

An (a) in FIG. 1 is a display apparatus in an embodiment of the invention in a state of non-high efficiency charging mode, and a (b) is image content displayed by a display module of the (a) in non-high efficiency charging mode. An (a) in FIG. 2 is a display apparatus in an embodiment in FIG. 1 in a state of high efficiency charging mode, and a (b) is image content displayed by a display module of the (a) in high efficiency charging mode.

A display apparatus 100 includes a display module 110 and a solar cell module 120. The display module 110 displays image content V and provides a charging light Lc. The solar cell module 120 is disposed at one side of the display module 110 to receive the charging light Lc and proceed to charge.

In the embodiment, the display module 110 is a reflective display module, and the solar cell module 120 is a transmission solar cell module. In other words, the display module 110 may reflect an ambient light L and the solar cell module 120 may be transmitted by the ambient light L. In addition, the solar cell module 120 in the embodiment is disposed at one side of a reflective light emitting surface of the display module 110, which means that the display module 110 reflects the ambient light L and that the solar cell module 120 is on a transmitting path of the ambient light L being reflected. As a result, the ambient light L being reflected may serve as the charging light Lc for the solar cell module 120 to proceed to charge, which further enhances the efficiency of charging for the solar cell module 120.

Specifically, in the embodiment, energy of the charging light Lc is related to the image content V. Accordingly, the efficiency of charging for the solar cell module 120 is related to the image content V displayed by the display module 110. When the ambient light L exposes to the display apparatus 100, a portion of the ambient light L transmits the solar cell module 120 and then exposes to the display module 110; and a portion of the ambient light L enables the solar cell module 120 to proceed to charge. Please refer to the (a) in FIG. 1 first, if the display apparatus 100 is in non-high efficiency charging mode, the image content V displayed by the display module 110 is low efficiency image content D which is more likely to absorb the ambient light L, as the (b) in FIG. 1, the low efficiency image content D is, for example, a dark color view. At this moment, the display module 110 absorbs most of the ambient light L which transmits the solar cell module 120, and a small portion of the ambient light L is reflected back to the solar cell module 120 by the display module 110. Therefore, when the display apparatus 100 is in non-high efficiency charging mode, the display module 110 provides the charging light Lc with lower energy for the solar cell module 120 to receive, such that the main charging mechanism of the solar cell module 120 comes from the ambient light L which transmits the solar cell module 120 from the outside.

Next, please refer to the (a) in FIG. 2, when the display apparatus 100 is in high efficiency charging mode, the image content V displayed by the display module 110 presents high efficiency image content W, which is an image more likely to reflect the ambient light L, such as the (b) in FIG. 2, the high efficiency image content W is, for example, a white color image. As a result, due to the high efficiency image content W with a better reflection effect, the display module 110 may reflect most of the ambient light L which transmits the solar cell module 120 back to the solar cell module 120 to serve as the charging light Lc. In other words, when the display module 110 displays the high efficiency image content W, the display module 110 may provide the charging light Lc with high energy for the solar cell module 120 to charge. According to the aforementioned, when the display apparatus 100 is in high efficiency charging mode, it is equivalent to that the ambient light L is being used twice for enhancing the efficiency of charging for the solar cell module 120.

In the embodiment, the display module 110 may be, for example, reflective e-paper, an interferometric modulator (imod), an electrowetting modulator, a cholesteric liquid crystal display (CLCD), a transflective liquid crystal display (LCD), a reflective liquid crystal display (LCD), or other appropriate reflective displays. The solar cell module 120 may be a monocrystalline silicon type solar cell, a polycrystalline silicon type solar cell, a thin film solar cell, a dye sensitized (DS) solar cell, or other appropriate solar cell modules.

To be specific, the display apparatus 100 may further includes a detection unit 130 disposed on the display module 110 or on the solar cell module 120. In FIGS. 1 and 2, that the detection unit is disposed on the display module 110 is demonstratively illustrated. In the embodiment, when the display apparatus 100 is in high efficiency charging mode, the display module 110 displays the high efficiency image content W according to a high efficiency image control signal F provided by the detection unit 130, so as to enhance the efficiency of charging for the solar cell module 120. Furthermore, the detection unit 130 may detect a system state of the display apparatus 100 and an intensity of the ambient light L. When the system state of the display apparatus 100 or the intensity of the ambient light L meets the conditions of getting into the high efficiency charging mode, the detection unit 130 outputs the high efficiency image control signal F, so as to enable the display module 110 to display the high efficiency image content W.

With respect to the system state of the display apparatus 100, the system state of the display apparatus 100 may be, for example, that when the detection unit 130 detects the power supply for the display apparatus 100 is already lower than a certain voltage value, that is, for example, the voltage of a cell is lower than 8 volt, the detection unit 130 outputs the high efficiency image control signal F. Or, when the detection unit 130 detects that the display apparatus 100 is in a standby state, for example, when the display apparatus 100 has already idled for a while, the detection unit 130 outputs the high efficiency image control signal F. Or, when the detection unit 130 detects that the display apparatus 100 has already been set as getting into the high efficiency charging mode, for example, when the display apparatus 100 has been manually set to the high efficiency charging mode by users, the detection unit 130 outputs the high efficiency image control signal F. Or, when the detection unit 130 detects that the way the display apparatus 100 is placed matches a predetermined way of placing, for example, when the non-display surface of the display apparatus 100 is leaning against another subject, the detection unit 130 outputs the high efficiency image control signal F. In addition, with regard to the intensity of the ambient light L, when the detection unit 130 detects that the intensity of the ambient light L is too weak, for example, when the display apparatus 100 gets into a dark place, the detection unit 130 may output the high efficiency image control signal F.

An (a) in FIG. 3 is a display apparatus in another embodiment of the invention in a state of non-high efficiency charging mode, and a (b) is image content displayed by the display module of the (a) in non-high efficiency charging mode. An (a) in FIG. 4 is a display apparatus in the embodiment in FIG. 3 in a state of high efficiency charging mode, and a (b) is image content displayed by the display module of the (a) in high efficiency charging mode.

A display apparatus 100A in the embodiment includes a display module 110A and a solar cell module 120A, wherein the display module 110A is a transmission display module, and the solar cell module 120A is a reflective solar cell module. The solar cell module 120A is disposed at one side of a transmission light emitting surface of the display module 110A to receive a charging light Lc.

In other words, the display module 110A may be transmitted by an ambient light L to arrive at the solar cell module 120A. The ambient light L of the transmission display module 110A may serve as the charging light Lc to be received by the solar cell module 120A so as to proceed to charge.

Please refer to the (a) in FIG. 3 first, if the display apparatus 100A is in non-high efficiency charging mode, image content V displayed by the display module 110A is low efficiency image content D which is more likely to block the ambient light L, as the (b) in FIG. 3, the low efficiency image content D is, for example, a dark color image. At this moment, the display module 110A blocks most of the ambient light L, and a small portion of the ambient light L transmits the display module 110A and exposes to the solar cell module 120A. Therefore, when the display apparatus 100A is in non-high efficiency charging mode, the display mode 110A provides a charging light Lc with low energy to enable the solar cell module 120A to charge.

Next, please refer to the (a) in FIG. 4, when a display apparatus 100A is in high efficiency charging mode, image content V displayed by the display module 110A presents high efficiency image content Wt, which is an image more likely to be transmitted by an ambient light L, as the (b) in FIG. 4, the high efficiency image content Wt is, for example, a transparent image. As a result, due to the high efficiency image content Wt with a better transmission effect, the display module 110A may enable most of the ambient light L radiates to the solar cell module 120A so as to serve as a charging light Lc. In other words, when the display module 110 displays the high efficiency image content Wt, the display module 110 may provide the charging light Lc with high energy for the solar cell module 120 to charge, which further enhances the efficiency of charging for the solar cell module 120.

In the embodiment, the display module 110A may be a transmission liquid crystal display (LCD), a transflective liquid crystal display, an electrochromism (EC) display, or other appropriate transmission display module.

An (a) in FIG. 5 is a display apparatus in another embodiment of the invention in a state of non-high efficiency charging mode, and a (b) is image content displayed by a display module of the (a) in non-high efficiency charging mode. An (a) in FIG. 6 is a display apparatus in an embodiment in FIG. 5 in a state of high-efficiency charging mode, and a (b) is image content displayed by a display module of the (a) in high efficiency charging mode.

A display apparatus 100B in the embodiment includes a display module 110B and a solar cell module 120B, wherein the display module 110B is a transmission display module, and the solar cell module 120B is a transmission solar cell module. The solar cell module 120B is disposed at one side of a transmission light emitting surface of the display module 110B to receive a charging light Lc.

In other words, the display module 110B and the solar cell module 120A may be transmitted by the ambient light L. The solar cell module 120B is on a transmitting path of an ambient light L which transmits the display module 110B. As a result, the ambient light L which transmits the display module 110B may serve as the charging light Lc and to be received by the solar cell module 120B to proceed to charge. On the other hand, since the solar cell module 120B in the embodiment is a transmission solar cell module, the solar cell module 120B may also receive an ambient light L from other directions in addition to the ambient light L which transmits the display module 110B.

Since the display module 110B in the embodiment is a transmission display module, please refer to the content of the embodiments in FIGS. 3 and 4 respectively for a detailed description regarding the display apparatus 100B in the embodiment in non-high efficiency charging mode and in high efficiency charging mode, no further description is to be incorporated herein.

It should be noted that, in a number of embodiments, the solar cell modules 120, 120A and 120B described above may also be, for example, an edge-lit transmission solar cell module. The edge-lit transmission solar cell module is disposed at the edge of the display module 110B, and a charging light Lc is guided to the edge-lit transmission solar cell module via a light guide panel to proceed to charge.

In addition, the high efficiency image content W, Wt, and the low efficiency image content D described in each of the embodiments described above are not limited to the form provided herein. Substantially, the focus of the low efficiency image content D is on being more likely to absorb an ambient light L or on blocking the ambient light L, whereas the focus of the high efficiency image content W and Wt is on being more likely to enable the ambient light L to radiate or on enabling the ambient light L to reflect.

Through the aforementioned three embodiments, a high efficiency charging method for a display apparatus may be disclosed together. FIGS. 7A and 7B are flow charts of a high efficiency charging method for a display apparatus in an embodiment of the invention. Please refer to both FIGS. 7A and 7B, a high efficiency charging method 1000A for the display apparatus described above is summarized as and includes the following steps: detecting a system state of the display apparatus or an intensity (S1100) of an ambient light, then judging if the display apparatus meets the conditions (S1200) of getting into high efficiency charging mode according to the system state of the display apparatus or the intensity of the ambient light.

Following that, if the system state of the display apparatus or the intensity of the ambient light meets the conditions of getting into the high efficiency charging mode, then controlling a display module to display high efficiency image content (S1300). The high efficiency image content may enhance energy of a charging light of a solar cell module provided by the display module, which further enhances the efficiency of charging for the solar cell module.

To be specifically, the step S1200 further includes judging if the display apparatus is in a low power state, if the display apparatus is in a standby state, if the display apparatus is set to high efficiency charging mode, if the way the display apparatus is placed matches a predetermined way of placing, or if an intensity of an ambient light is too low (as the step S1240 shown in FIG. 7B).

In the embodiment, the display apparatus is, for example, the display apparatus 100 described above, although the display apparatus may also be the display apparatus (such as the display apparatuses 100A and 100B) in the other embodiments (such as the embodiments in FIGS. 3 and 5) described above. Therefore, the charging light is an ambient light which transmits the display module or is obtained via an ambient light reflected by the display module.

FIG. 8 is a flow chart of a high efficiency charging method for a display apparatus in another embodiment of the invention. In the embodiment and the embodiment in FIG. 7A, the differences between the two embodiments are described below. To be specific, a high efficiency charging method 1000B for the display apparatus in the embodiment further includes detecting if an electric quantity of a solar cell module is full before detecting a system state of the display apparatus or an intensity (S1100) of an ambient light and keeping detecting the electric quantity (S1060) of the solar cell module if the electric quantity of the solar cell module is full.

Take practical products as examples, the display apparatus 100 is, for example, an electronic book having a transparent solar charging module. When the power supply capability of the electronic book only allows a user to turn another 200 pages of an electronic document, or when the electronic book has not been in use for more than three minutes, the display apparatus 100 gets into high efficiency charging mode. At this moment, the electronic document on the screen of the electronic book is replaced with an image with white background, and characters "charging" is shown in a corner of the white image to proceed with high efficiency charging.

Or for example, a display apparatus 100A is a notebook having a transmission liquid crystal display (LCD). When the power capability of the notebook is already lower than 100%, adjust an image of the notebook to a form with more white level, so as to enable the power capability of the notebook to recover to 100% by using the high efficiency charging mode. Thereafter, recall the original image of the notebook.

Or for example, a display apparatus 100B is a mobile phone having a transflective liquid crystal screen. In order to make the lasting time of the mobile phone last longer, a user manually activates the high efficiency charging mode of the mobile phone. An image of the mobile phone is therefore adjusted to a form with more white level.

In summary, a display apparatus in the embodiments of the invention may increase an ambient light which transmits a display module or an ambient light reflected by the display module through high efficiency display content, so as to enhance energy of a charging light, which further enhances the efficiency of charging for a solar cell module.

Although the invention has been disclosed by the above embodiments, the embodiments are not intended to limit the invention. It will be apparent to those skilled in the art that various modifications and variations can be made to the structure of the invention without departing from the scope or spirit of the invention. Therefore, the protecting range of the invention falls in the appended claims.

What is claimed is:

1. A display apparatus, comprising:

a display module, displaying image content and providing a charging light, wherein energy of the charging light varies in response to light transparency or light reflectivity of the display module adjusted by shifting the image content thereof;

a solar cell module, disposed at one side of the display module to receive the charging light and proceed to charge, wherein efficiency of charging for the solar cell module is in response to the energy of the charging light; and a detection unit, disposed on the display module or on the solar cell module, detecting one of a system state of the display apparatus and an intensity of an ambient light, wherein the display apparatus is in a high efficiency charging mode when the display apparatus is in a low power state or a standby state, or when the intensity of the ambient light is low, and when one of the system state of the display apparatus and the intensity of the ambient light meets at least one of the conditions of getting into high efficiency charging mode, outputting a high efficiency image control signal, and the display module displays high efficiency image content according to the high efficiency image control signal, so as to enhance efficiency of charging for the solar cell module.

2. The display apparatus according to claim 1, wherein the display module is a reflective display module, and the solar cell module is a transmission solar cell module, and the solar cell module is disposed at one side of a reflective light emitting surface of the display module, the display module reflects an ambient light to provide the charging light.

3. The display apparatus according to claim 2, when the display apparatus is in high efficiency charging mode, the display module displays high efficiency image content which is a white image.

4. The display apparatus according to claim 1, wherein the display module is a transmission display module and the solar cell module is a reflective solar cell module, and the solar cell module is disposed at one side of a transmission light emitting surface of the display module to receive the charging light, wherein the charging light is an ambient light which transmits the display module.

5. The display apparatus according to claim 4, when the display apparatus is in high efficiency charging mode, the display mode displays high efficiency image content which is a transparent image.

6. The display apparatus according to claim 1, wherein the display module is a transmission display module and the solar cell module is a transmission solar cell module, and the solar cell module is disposed at one side of a transmission light emitting surface of the display module to receive the charging light, wherein the charging light is an ambient light which transmits the display module.

7. The display apparatus according to claim 6, when the display apparatus is in high efficiency charging mode, the display module displays high efficiency image content which is a transparent image.

8. The display apparatus according to claim 1, when the detection unit detects that the display apparatus is in the low power state or the standby state, that the display apparatus is set to the high efficiency charging mode, that a way the display apparatus is placed matches a predetermined way of placing, or that when the intensity of the ambient light is too low, the detection unit outputs the high efficiency image control signal.

9. A high efficiency charging method for a display apparatus, the display apparatus includes a display module and a solar cell module, the high efficiency charging method for the display apparatus includes:

detecting a system state of the display apparatus or an intensity of an ambient light;

judging when the display apparatus meets the conditions of getting into high efficiency charging mode according to the system state of the display apparatus or the intensity of the ambient light, wherein the display apparatus is in the high efficiency charging mode when the display apparatus is in a low power state or a standby state, or when the intensity of the ambient light is low; and when the system state of the display apparatus or the intensity of the ambient light meets at least one of the conditions of getting into high efficiency charging mode, controlling the display module to display high efficiency image content, so as to enhance energy of a charging light of one of the solar cell modules provided by the display module, which further enhances efficiency of charging for the solar cell module, wherein the energy of the charging light varies in response to light transparency or light reflectivity of the display module adjusted by shifting the image content thereof.

10. The high efficiency charging method for the display apparatus according to claim 9, wherein the charging light is an ambient light which transmits the display module or is obtained through reflecting the ambient light via the display module.

11. The high efficiency charging method for the display apparatus according to claim 9, judging when the display apparatus meets the conditions of getting into the high efficiency charging mode according to a system state of the display apparatus or an intensity of an ambient light includes steps of:

judging when the display apparatus is in the low power state, when the display apparatus is in the standby state, when the display apparatus is set to high efficiency charging mode, when a way the display apparatus is placed matches a predetermined way of placing, or when the intensity of the ambient light is too low.

12. The high efficiency charging method for the display apparatus according to claim 11, when the display apparatus is in a low power state or a standby state, when the display apparatus is set to high efficiency charging mode, when the way the display apparatus is placed matches the predetermined way of placing, or when the intensity of the ambient light is too low, the display apparatus meets the conditions of getting into the high efficiency charging mode.

13. The high efficiency charging method for the display apparatus according to claim 9, further comprising:

detecting when an electricity quantity of the solar cell module is full; and keeping detecting the electricity quantity of the solar cell module when the electricity quantity of the solar cell module is full.

* * * * *